US008776556B2

(12) United States Patent
Lai

(10) Patent No.: US 8,776,556 B2
(45) Date of Patent: Jul. 15, 2014

(54) COMBINATION PADLOCK WITH SECONDARY OPENING MECHANISM

(71) Applicant: The Sun Lock Company, Ltd., Tuen Mun (HK)

(72) Inventor: Karl Lai, Hong Kong (HK)

(73) Assignee: The Sun Lock Company, Ltd., Tuen Mun, NT (HK)

( * ) Notice: Subject to any disclaimer, the term of this patent is extended or adjusted under 35 U.S.C. 154(b) by 0 days.

(21) Appl. No.: 13/671,733

(22) Filed: Nov. 8, 2012

(65) Prior Publication Data

US 2013/0118215 A1 May 16, 2013

Related U.S. Application Data

(60) Provisional application No. 61/629,301, filed on Nov. 15, 2011.

(51) Int. Cl.
*E05B 37/06* (2006.01)

(52) U.S. Cl.
USPC ..... 70/21; 70/25; 70/284; 70/285; 70/38 A; 70/38 B

(58) Field of Classification Search
USPC ..... 70/21, 25, 26, 284, 285, 38 A, 38 B, 70/DIG. 63, DIG. 71
See application file for complete search history.

(56) References Cited

U.S. PATENT DOCUMENTS

| | | | | |
|---|---|---|---|---|
| 4,829,794 | A * | 5/1989 | Crown | 70/25 |
| 5,715,709 | A | 2/1998 | Lai | 70/25 |
| 6,848,283 | B1 | 2/2005 | Lin | |
| 7,140,209 | B2 * | 11/2006 | Lai | 70/25 |
| 2006/0150690 | A1 | 7/2006 | Lai et al. | |

FOREIGN PATENT DOCUMENTS

CN 202249245 U 5/2012

* cited by examiner

*Primary Examiner* — Suzanne Barrett
(74) *Attorney, Agent, or Firm* — Ware, Fressola, Maguire & Barber LLP

(57) ABSTRACT

A padlock that can be locked and unlocked by both dials and a secondary opening mechanism, the padlock including a lock body, a shackle with a long leg and a short leg where the shackle can move between a locked configuration in which the short leg is secured in the lock body and an opened configuration in which the short leg is removable from the lock body. The padlock includes a combination mechanism, including a plurality of clutches mounted around the long leg of the shackle and corresponding dials mounted in the lock body each having teeth configured to engage with an extended fin of one of the clutches and a top cap seal configured to prevent the combination mechanism from being pulled apart from the lock body. A cam having a hole formed therein is configured to allow a key-user to decode a code used to unlock the padlock.

21 Claims, 10 Drawing Sheets

COMBINATION PADLOCK WITH SECONDARY OPENING MECHANISM

CROSS-REFERENCE TO RELATED APPLICATIONS

This application claims priority to U.S. Provisional Appl. No. 61/629,301 filed Nov. 15, 2011, which is hereby incorporated by reference in its entirety.

BACKGROUND OF THE INVENTION

1. Field of the Invention

This invention relates to locks. More particularly, to a combination padlock with a secondary opening mechanism.

2. Description of Related Art

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

The combination padlock as set forth in U.S. Pat. No. 5,715,709, which is hereby incorporated by reference in its entirety, describes a simple and effective combination padlock in terms of construction and operation. However, it may be desirable to have a secondary mechanism to open the combination padlock. In particular, for padlocks that may be used in locker rooms, such as those found in workout centers, gymnasiums and the like, the staff of such institutions may need a combination padlock that is resettable for the members and/or visitors of such institutions. After a member or visitor returns the padlock, the padlock combination (code used to open the padlock) cannot be independently determined by the staff, causing the staff to throw the padlock away because it cannot be opened. While some of the existing combination padlocks can be opened by a secondary locking mechanism, such as a locking mechanism that can be opened through the use of a key, the padlocks can only be opened by using the key, and such mechanism cannot help the user, e.g. staff, in resetting the combination code, which was set by the previous user, e.g. member or visitor. As a result, the padlock may only be opened through use of the key, and the combination aspect of the padlock is rendered useless since the combination is no longer known.

In today's market, people would like to have a secondary mechanism to open a combination padlock. Especially for lockers in gymnasiums, clubs, workout centers, and the like, it is desirable that the staff could provide a combination padlock to their club-member, where the code for unlocking the padlock is resettable yet, after the member returned the padlocks, the code could be reset. This is especially important when the user sets the code (combination), but does not tell the staff. Many times, padlocks have to be discarded for this reasons since the padlock cannot be re-coded (even if it can be unlocked with a master key). Some of the existing combination padlock can be opened by a secondary locking mechanism such as a key, however, they can just open the padlock by using the key but such mechanism cannot help the user (staff) to reset the combination code, which was previously set by a user (club-member). In order to solve this problem, the present invention provides an improved padlock whose code can be reset.

The present invention is directed to a padlock which solves the problem of resettable padlocks and the need for being able to re-assign a combination code after a combination has been previously used.

SUMMARY OF THE INVENTION

The present invention is designed to overcome the above noted limitations that are attendant upon the use of conventional padlocks and, toward this end, it contemplates the provision of a novel padlock that is configured to be unlocked/opened by a first locking mechanism or a second locking mechanism.

Accordingly, it is an object of the present invention to provide a padlock that has a combination locking mechanism and a tool or key-operated locking mechanism.

It is yet another object of the present invention to provide a padlock that can be unlocked/opened through the use of either the combination locking mechanism and/or the key-operated locking mechanism.

It is still another object of the present invention to provide a padlock in which the combination of the combination locking mechanism required to unlock/open the padlock can be determined and/or reset through the use of the key-operated locking mechanism.

It is still a further object of the present invention to provide a padlock in which the combination of the combination locking mechanism required to unlock/open the padlock can be reset and/or reconfigured through operation of the combination locking mechanism while the padlock is in the unlocked/opened configuration.

It is yet another object of the present invention to provide a padlock that is tamper-resistant and/or proof.

It is still another object of the present invention to provide a padlock having features that eliminate and/or reduce the likelihood that a third-party may be able to unlock/open the padlock through the use of the combination locking mechanism without knowledge of the combination required to unlock/open the padlock and/or without a key required for the key-operated locking mechanism.

It is yet another object of the present invention to provide a padlock in which the combination of the combined locking mechanism required to unlock/open the padlock can only be reset and/or reconfigured through use of the key-operated locking mechanism.

Exemplary embodiments of the present invention are directed to a padlock that contains a combination locking mechanism that includes a plurality of faulty-notches associated with each dial of the combination locking mechanism that increase the difficulty of picking the padlock. It is understood that the combination locking mechanism that maybe used according to exemplary embodiments of the present invention may include, but is not limited, to any mechanism that requires entry and/or configuration of a particular sequence and/or combination in order to open/unlock the mechanism. The padlock may also include a top cap seal that has a plurality of extended protrusions, for example three, while a lock body of the padlock has corresponding slots to receive these protrusions in a manner that prevents the top cap seal from being twisted open by an unauthorized user, thereby providing a secured sealed cap.

An exemplary embodiment of the present invention is directed to a padlock having a lock body, a shackle with a long leg and a short leg, a plurality of clutches that are mounted in the long leg of the shackle which help to prevent the shackle from being pulled upward if extended fins of the clutches are not aligned with the opening notches in the lock body, wherein a plurality of dials corresponding to the clutches are mounted in the lock body which have teeth to engage with the extended fins of the plurality of clutches, a top cap seal to prevent the clutches from being pulled apart from the lock body, a cam which has a hole formed therein so as to allow a key-user to decode the combination if the hole is aligned with a hole in the short leg shackle of the lock body and further wherein the cam has a surface which allows the short leg of the shackle to rest on the surface if the cam is in a locked position, thereby insuring that the hole in the cam is not aligned with the short leg shackle hole of the lock body and a cylinder which has a fork to contact the bottom of the cam such that the movement of the cylinder will be directly transferred to the cam.

An embodiment of the present invention is a padlock comprising a lock body; a shackle with a long leg and a short leg, the short leg having a hole formed therein, the shackle movable between a locked configuration in which the short leg is secured in the lock body and an open configuration in which the short leg is removed from the lock body; a combination mechanism comprising a plurality of clutches mounted in the long leg of the shackle, the clutches configured to help prevent the shackle from being pulled upward; a plurality of dials corresponding to the plurality of clutches, the plurality of clutches mounted in the lock body and each having teeth configured to engage with an extended fin of one of the clutches; a top cap seal configured to prevent the combination mechanism from being pulled apart from the lock body; a cam having a hole formed therein, the hole configured to allow a key-user to decode a code if the hole is aligned with the short leg shackle hole, the code allowing the shackle to be pulled to the open configuration if the dials are configured in a manner that corresponds to said code; and a cylinder, having a fork, the fork configured to contact a bottom of the cam such that movement of the cylinder is directly transferred to the cam.

A further embodiment of the present invention is a padlock as described above, wherein the key-user with a correct key can turn cylinder and then turn the cam to reset the codes without knowledge of the previous code.

A still further embodiment of the present invention is a padlock as described above, wherein the key mechanism in the padlock is an independent mechanism, which will not interrupt the mechanism of the combination dial if the key is not present.

Another embodiment of the present invention is a padlock as described above, wherein the key mechanism (the cylinder, the cam, and the relationship between the shackle, and the clutches) can help the key-user to transition the padlock from the lock mode into reset combination mode.

Another exemplary embodiment of the present invention is directed to a padlock that may include a lock body, a shackle having a long leg and a short leg, where the shackle is movable between a locked configuration in which the short leg is at least partially surrounded by the lock body, and a unlocked configuration in which the short leg is removed from the lock body. The padlock may also include a combination locking mechanism that may include at least one clutch mounted around the long leg of the shackle and configured for rotation about the long leg of the shackle, and at least one rotatable dial operatively engaged with the at least one clutch and configured to impart rotational motion upon the at least one clutch. The padlock may also include a tool operated locking mechanism that may include a cam and a cylinder operatively engaged with the cam, where the cam may include an off-centered hole form therein, and where the tool operated locking mechanism is movable between a blocking configuration in which the off-centered hole is not aligned with the short leg of the shackle and an open configuration in which the off-centered hole is aligned with the short leg of the shackle.

In accordance with this exemplary embodiment of the present invention, the shackle is further movable to a combination reset configuration at least when the tool operated locking mechanism is in the open configuration, and in the combination reset configuration the at least one rotatable dial is disengaged from the at least one clutch so that the at least one rotatable dial is free to rotate without imparting rotational motion upon the at least one clutch.

In accordance with this exemplary embodiment of the present invention, the padlock may also include a top cap seal configured to prevent the combination mechanism from being pulled apart from the lock body.

In accordance with this exemplary embodiment of the present invention, the combination locking mechanism is configured for entry of a combination configured to permit movement of the shackle into the unlocked configuration.

In accordance with this exemplary embodiment of the present invention, the at least one clutch may include an extended fin radially extending from an outer surface of the at least one clutch, and the at least one rotatable dial may include a plurality of teeth configured to engage with the extended fin of the at least one clutch so that rotational motion of the at least one rotatable dial is transferred to the at least one clutch.

In accordance with this exemplary embodiment of the present invention, the lock body may include a first bore dimensioned to receive at least part of the long leg of the shackle and the at least one clutch, and at least one cutout portion positioned substantially perpendicular to the first bore and dimensioned to receive the at least one rotatable dial.

In accordance with this exemplary embodiment of the present invention, the at least one cutout portion may include an upper surface and a lower surface, and the upper surface having an upper notch and a plurality of faulty-notch zones, and the lower surface having a lower notch substantially aligned with the upper notch.

In accordance with this exemplary embodiment of the present invention, the upper notch and the lower notch are dimensioned so as to allow at least the extended fin of the at least one clutch to pass there through when the extended fin is aligned with the upper notch or the lower notch, and the shackle is movable to the unlocked configuration when the extended fin is aligned with the upper notch.

In accordance with this exemplary embodiment of the present invention, the at least one rotatable dial may include a plurality of faces, and each face of the plurality of faces may include an indicia thereon, and one of the indicia on the plurality of faces provides an indication when the extended fin is aligned with the upper notch.

In accordance with this exemplary embodiment of the present invention, the padlock may also include a top cap seal at least partially inserted into an end of the first bore and having a first alignment notch formed therein.

In accordance with this exemplary embodiment of the present invention, the shackle may also include a protrusion extending from the long leg and configured for alignment with the first alignment notch of the top cap seal when the shackle is movable to the unlocked configuration.

In accordance with this exemplary embodiment of the present invention, the shackle is only movable to the combination reset configuration when the tool operated locking mechanism is in the open configuration.

In accordance with this exemplary embodiment of the present invention, the shackle is configured for rotation about the long leg when the shackle is in the unlocked configuration, and the top cap seal may also include a second alignment notch configured for alignment with the protrusion in order to align the shackle into the combination reset configuration and thereby disengaging the at least one clutch from the at least one rotatable dial.

In accordance with this exemplary embodiment of the present invention, when the second alignment notch is aligned with the protrusion the shackle is movable in a direction towards the lock body, and such movement is configured to move the extended fin of the at least one clutch into the lower notch and thereby disengage the extended fin from the plurality of teeth of the at least one rotatable dial.

In accordance with this exemplary embodiment of the present invention, the cylinder is configured to receive a tool configured to move the tool operated locking mechanism between the blocking configuration and the open configuration, and the tool is configured to rotate the cylinder and the cam so that the off-centered hole is aligned with the short leg of the shackle.

In accordance with this exemplary embodiment of the present invention, the cylinder may include a fork configured to contact the cam such that movement of the cylinder is directly transferred to the cam.

In accordance with this exemplary embodiment of the present invention, the cylinder and the cam are made of a single piece construction.

In accordance with this exemplary embodiment of the present invention, the cylinder may include a lock cylinder, and the tool may include a correct-cut key configured to operate the lock cylinder.

In accordance with this exemplary embodiment of the present invention, when the off-centered hole is aligned with the short leg of the shackle the short leg of the shackle is configured for movement into the off-centered hole and the shackle is configured for movement in a direction towards the lock body.

In accordance with this exemplary embodiment of the present invention, when the shackle is moved in the direction towards the lock body the extended fin of the at least one clutch will either contact the lower surface of the cutout portion or engage with the lower notch if a correct indicia for the at least one rotatable dial corresponding to the at least one clutch has been set.

In accordance with this exemplary embodiment of the present invention, the extended fin of the at least one clutch contacts the lower surface of the cutout portion, the rotatable dial may be rotated until the extended fin engages with the lower notch in order to determine the correct indicia for the at least one rotatable dial.

In accordance with this exemplary embodiment of the present invention, when the extended fin of the at least one clutch engages with the lower notch the shackle may continue to be moved in the direction towards the lock body and into the combination reset configuration in order to disengaged the extended fin of the at least one clutch from the plurality of teeth of the at least one rotatable dial.

In accordance with this exemplary embodiment of the present invention, the lock body may also include a second bore dimensioned to receive the cam and the cylinder, and a third bore opening into the second bore and dimensioned to receive at least a portion of the short leg of the shackle.

In accordance with this exemplary embodiment of the present invention, the off-centered hole of the cam is configured for alignment with the third bore when the tool operated locking mechanism is in the open configuration, and when the tool operated locking mechanism is in the open configuration the short leg of the shackle is positioned so as to enter the third bore and the off-centered hole of the cam.

BRIEF DESCRIPTION OF THE DRAWINGS

For a fuller understanding of the nature and objects of the present invention, reference should be made to the following detailed description taken in connection with the accompanying drawings, in which.

DETAILED DESCRIPTION

Figure 1:
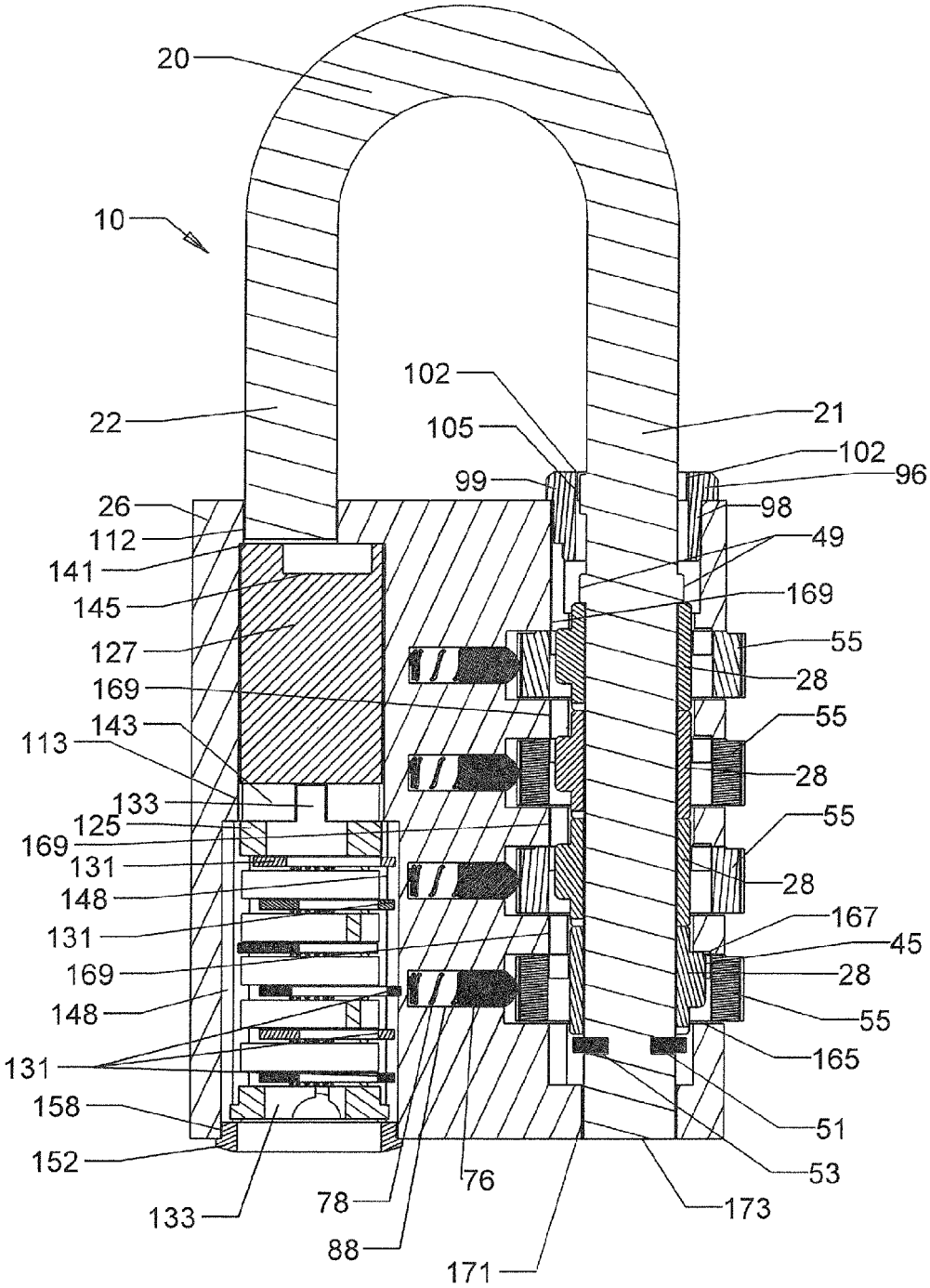
FIG. 1 is a cross-sectional view of an exemplary padlock of the present invention showing the internal components of the padlock in the closed or locked state.
Figure 2:
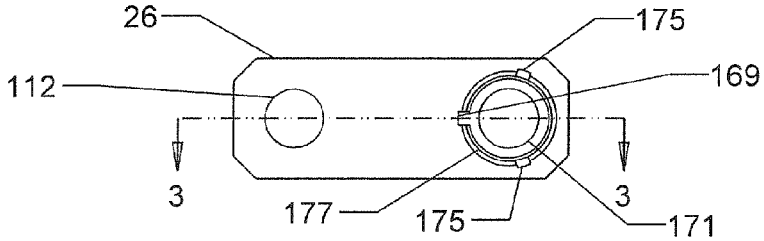
FIG. 2 is a top plan view of the padlock body.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 10:
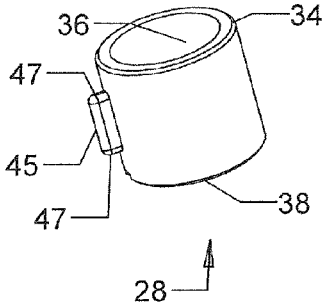
FIG. 10 is a perspective view showing the clutch of the padlock with the secondary locking mechanism of the present invention.

Referring now to FIG. 1, therein illustrated is an exemplary embodiment of a padlock, generally indicated by reference numeral 10, according to the present invention. The padlock 10 includes a shackle 20 having a long leg 21 and a short leg 22. The shackle 20 may preferably be a J-shaped shackle, but it is understood that the shackle 20 may have any suitable configuration and/or shape in accordance with exemplary embodiments of the present invention. The padlock 10 also includes a lock body 26 configured to retain at least the long leg 21 of the shackle 20. The shackle 20 is configured to be movable between a locked/closed configuration in which the short leg 22 of the shackle 20 is secured in the lock body 26 and an open/unlocked configuration in which the short leg 22 is removed from the lock body 26. The padlock 10 may also include a combination locking mechanism that includes at least one clutch 28 positioned around a portion of the long leg 21 of the shackle 20 and within the lock body 26. As shown in detail in FIG. 10, the clutch 28 includes a cylindrical body portion 34 and a circular bore 36 formed through the cylindrical body portion 34. The cylindrical body portion 34 has a substantially circular outer surface 38, and an extended fin 45 radially extending from the circular outer surface 38. The extended fin 45 includes a pair of tips 47 positioned at opposite ends of the extended fin 45.

Referring again to FIG. 1, the circular bore 36 of each of the clutches 28 has a diameter such that the long leg 21 of the shackle 20 may pass through the circular bore 36 and each of the clutches 28 may be configured to freely rotate about the long leg 21 of the shackle 20. The clutches 28 may be retained in their rotatable position on the long leg 21 of the shackle 20 by a dual-protrusion 49 extending from the long leg 21 of the shackle 20 and a split ring 51 inserted into a ring receiving slot 53. The positioning of the dual-protrusion 49 and the split ring 51 on the long leg 21 of the shackle 20 reduce and/or prohibit longitudinal movement of the clutches 28 along the shackle 20 while allowing rotational movement of the clutches 28 about the long leg 21 of the shackle 20. The combination locking mechanism of the padlock 10 may also include an independent rotatable dial 55 operatively coupled with each of the clutches 28 so that each clutch 28 is engaged with a rotatable dial 55 so that in the configuration shown in FIG. 1 rotational movement of the rotatable dial 55 is imparted to the clutch 28 operatively coupled to the corresponding rotatable dial 55.

Figure 13A:
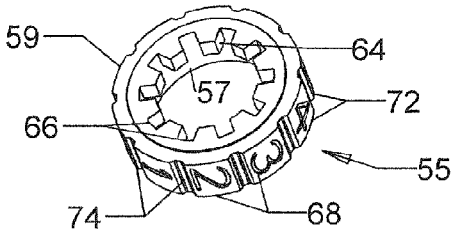
FIG. 13A is a front perspective view of an exemplary dial for use with the exemplary padlock of the present invention.
Figure 13B:
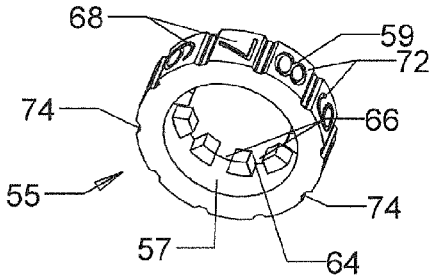
FIG. 13B is a bottom perspective view of the exemplary dial shown in FIG. 13A.

Referring now to FIGS. 13A and 13B, in which an exemplary embodiment of the rotatable dial 55 for use in the present invention is shown. The rotatable dial 55 includes an inside surface 57 and an outside surface 59. The inside surface 57 may have a diameter slightly greater than the diameter of the cylindrical body portion 34 of the clutch 28 so that the clutch 28 and the rotatable dial 55 are able to operatively engaged with each other while also being independently rotatable about the long leg 21 of the shackle 20 when not operatively engaged with each other. Extending from the inside surface 57 towards the center of the rotatable dial 55 are a plurality of teeth 64 that define a plurality of slots 66, where each slot 66 is formed between a pair of the plurality of teeth 64. Each slot 66 may be configured and dimensioned to receive and retain the extended fin 45 of the clutch 28 so that when the extended fin 45 is received and retained within the slot 66, the clutch 28 and the rotatable dial 55 are in interlocked engagement permitting both the clutch 28 and the rotatable dial 55 to be configured to rotate about the long leg 21 of the shackle 20. The rotatable dial 55 may also include one or more indicia 68 formed on the outside surface 59 thereof. It is understood that the number of slots 66 formed in the rotatable dial 55 may correspond to the number of separate and distinct indicia 68 formed on the outside surface 59 of the rotatable dial 55. Each of the indicia 68 represent one component of the combination that may be used to position the clutches 28 in the required location for releasing the shackle 20 from the lock body 26 through use of the combination locking mechanism, as will be discussed further below. It is understood that the indicia 68 may be any symbol, color, design, character or other mark, and may be for example alpha numeric characters. Each indicia 68 may be disposed on and/or formed on or in a separate face 72 positioned around the outside surface 59 of the rotatable dial 55. Each face 72 may be separated from adjacent faces 72 by channels 74 formed on the outside surface 59 of the rotatable dial 55.

Referring again to FIG. 1, the padlock 10 may also include a plurality of pins 76, where each pin 76 is positioned for operative engagement with a corresponding rotatable dial 55. Each pin 76 is also operatively coupled to a spring 78 that is configured to urge each pin 76 in a direction towards the rotatable dial 55 corresponding to the pin 76. Each pin 76 and spring 78 are mounted in a cylindrical slot 88 forming a receiving cavity in the lock body 26 for each pin 76 and spring 78. Each spring 78 is configured and positioned so as to urge the corresponding pin 76 into engagement with the outside surface 59 of the corresponding rotatable dial 55. As the rotatable dial 55 is rotated the pin 76 is moved in and out of the channels 74 formed in between the faces 72 of the rotatable dial 55 in order to cause an indication, for example an audible sound, that the rotatable dial 55 is in the proper orientation for a particular desired indicia 68. In addition to the indication produced by the cooperation of the pin 76 and channels 74 of the rotatable dial 55, the movement of the pin 76 into engagement with the channel 74 may also provide a structural indication that the particular desired indicia 68 is in its proper orientation.

Figure 6A:
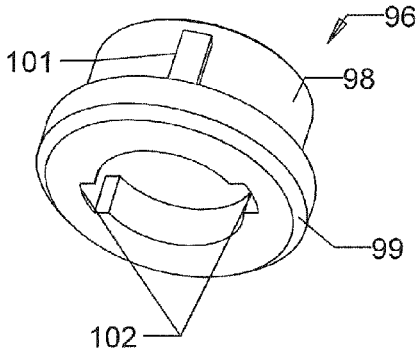
FIGS. 6A-6B are a series of perspective views showing the top cap seal member that may be incorporated into the padlock with a secondary locking mechanism of the present invention.
Figure 6B:
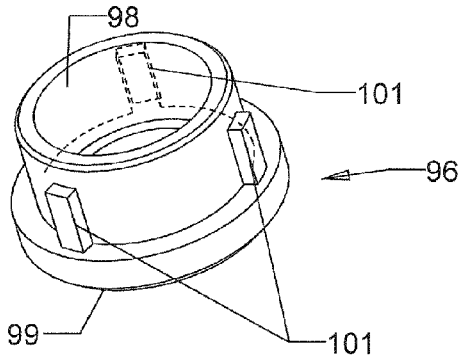

Still referring to FIG. 1, the padlock 10 may also include a top cap seal 96 that is configured to assist in the retention and/or alignment of the shackle 20 within the lock body 26. As shown in greater detail in FIGS. 6A, 6B, 18A and 18B, the top cap seal 96 includes a cylindrical body 98 and a circular flange 99 positioned substantially perpendicular to the cylindrical body 98. The cylindrical body 98 includes one or more extended protrusions 101 extending radially from the cylindrical body 98, and the circular flange 99 may include one or more notches 102 formed therein. For example a pair of notches 102 are shown in the circular flange 99 for the exemplary embodiment of the top cap seal 96 shown in FIGS. 6A and 6B. The number of notches 102 provided in the top cap seal 96 can be used to control the manner in which the combination of the combination locking mechanism of the padlock 10 may be reset, as will be discussed further below.

Referring again to FIG. 1, the top cap seal 96 may be inserted into the lock body 26 of the padlock 10 so that the cylindrical body 98 is within the lock body 26 and the circular flange 99 sits on an outside surface of the lock body 26. The top cap seal 96 may be configured to prevent the clutches 28 from being pulled apart from the lock body 26. The one or more notches 102 are also disposed so as to provide for alignment with at least one protrusion 105 extending from the long leg 21 of the shackle 20 so that when the shackle 20 is moved in a longitudinal direction away from the lock body 26 the shackle 20 may be properly oriented in order to be moved back within the lock body 26. The padlock 10 also includes a short shackle leg hole 112 formed in the lock body 26 and configured to receive at least a portion of the short leg 22 of the shackle 20. The padlock 10 may further include a bore 113 coupled to the short shackle leg hole 112 and dimensioned to hold a tool operated cylinder 125 and a cam 127. The tool operated cylinder 125 is configured for rotational operation through the use of an appropriate tool, for example a key with correct cuts formed thereon. In an exemplary embodiment of the present invention, an axis of the cam 127 and the tool operated cylinder 125 are the same, and an axis of the short leg 22 of the shackle 20 and the short leg shackle hole 112 of the lock body 26 are different than the axis of the cam 127 and the tool operated cylinder 125.

Figure 8:
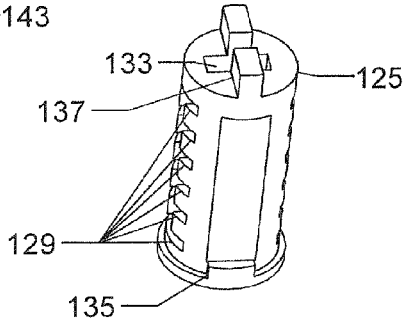
FIG. 8 is a perspective view showing the cylinder of the padlock with the secondary locking mechanism of the present invention.

Referring now to FIGS. 1 and 8, the tool operated cylinder 125 includes a plurality of wafer slots 129 that are dimensioned to receive and retain a plurality of wafers 131 that may be positioned substantially perpendicular to the longitudinal axis of the tool operated cylinder 125 so that the wafers 131 are also positioned substantially perpendicular to the bore 113 formed in the lock body 26. The tool operated cylinder 125 also includes a tool channel 133 configured to receive an appropriate tool, for example a key, configured to cause actuation and/or operation of the tool operated cylinder 125. The tool channel 133 is coupled with the plurality of wafer slots 129 so that when the tool is inserted into the tool channel 133 the tool may come into contact, either directly or indirectly, with the plurality of wafers 131 in order to position the plurality of wafers 131 in an appropriate configuration in order to permit actuation and/or operation of the tool operated cylinder 125. The tool operated cylinder 125 may also include at least one tab 135 formed on the side thereof. The tool operated cylinder 125 may also include a fork 137 extending from an end of the tool operated cylinder 125.

Figure 7A:
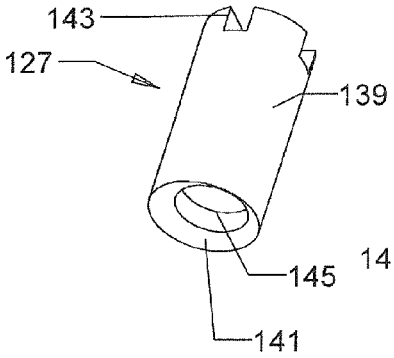
FIGS. 7A-7B are a series of perspective views showing the cam member that may be incorporated into the padlock with the secondary locking mechanism of the present invention.
Figure 7B:
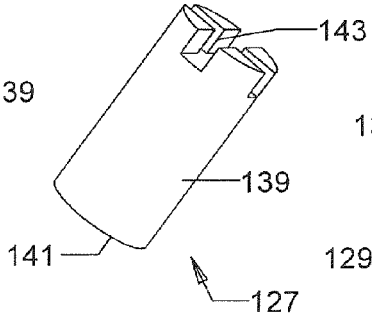

Referring now to FIGS. 1, 7A and 7B, the cam 127 may be formed from a cylindrical body plug 139 having a surface 141 at one end, and a plurality of legs 143 extending from the other end. The cam 127 also includes an off-centered hole 145 formed in the end having the surface 141. As shown in FIG. 1, when the cam 127 is positioned within the bore 113 the off-centered hole 145 is positioned so as to be not aligned with the short leg shackle hole 112 so that at least a portion of the surface 141 extends into the short leg shackle hole 112 and has a blocking arrangement with the short leg 22 of the shackle 20. As further shown in FIG. 1, the cam 127 and the tool operated cylinder 125 may be positioned within the bore 113 so that the fork 137 of the tool operated cylinder 125 is operatively coupled with the plurality of legs 143 extending from the cam 127. In this manner, movement of the tool operated cylinder 125 can be transferred to the cam 127, and as discussed further below the off-centered hole 145 may be aligned with the short leg shackle hole 112.

Figure 19:
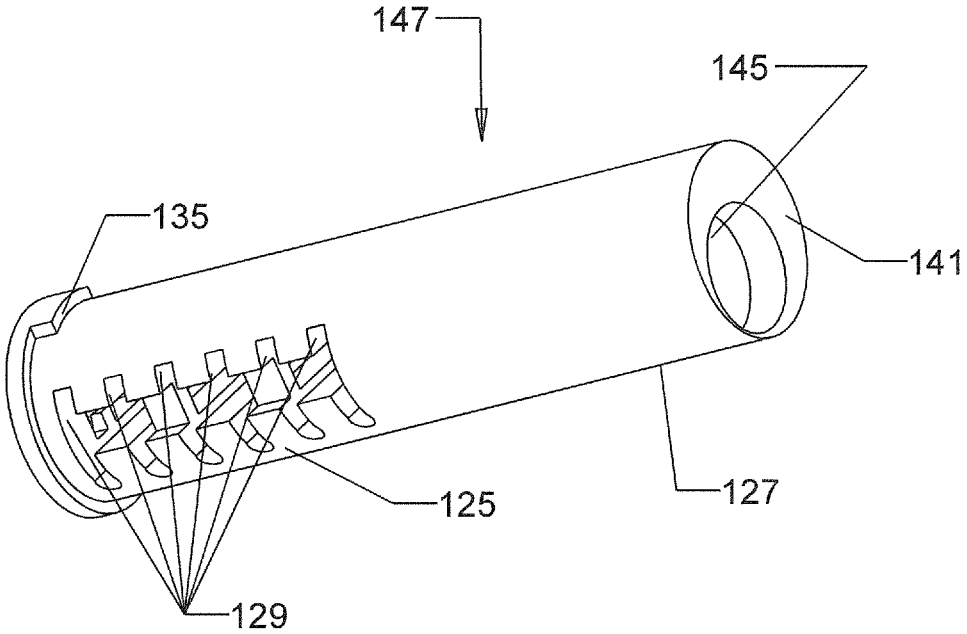
FIG. 19 is a perspective view of the second embodiment of the cylinder-cam illustrating the mixture of the cylinder and cam together.

Referring now to FIG. 19, an alternative exemplary embodiment of the tool operated cylinder 125 and the cam 127 is shown in which the tool operated cylinder 125 and the cam 127 are formed from a single piece construction 147. The single piece construction 147 includes the same components as the independent tool operated cylinder 125 and the cam 127 with the exception of the fork 137 and plurality of legs 143, as these components may be unnecessary in the single piece construction 147. It is understood that the present invention is not limited to either the single piece construction 147 or the separate tool operated cylinder 125 and the cam 127, as both are suitable for use with the present invention.

Figure 3:
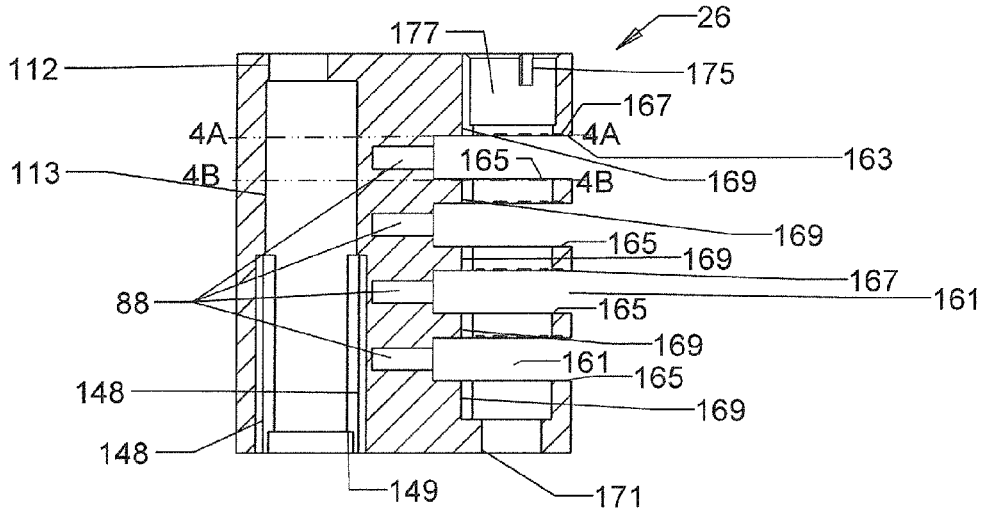
FIG. 3 is a cross-sectional view of the lock body taken along line 3-3 of FIG. 2.
Figure 5:
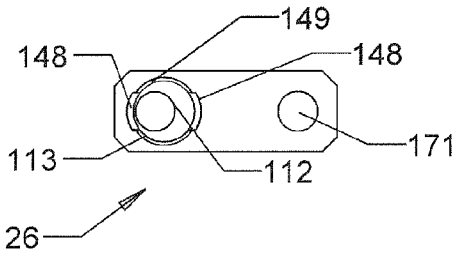
FIG. 5 is a is a bottom plan view of the padlock body.
Figure 4B:
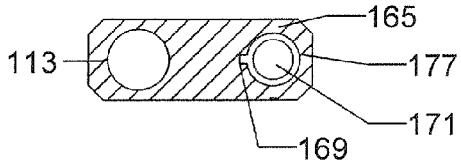
FIG. 4B is a cross-sectional view of the lock body, taken along line 4B-4B of FIG. 3.

Referring now to FIGS. 1, 3 and 5, the interaction of the tool operated cylinder 125 with the lock body 26 will now be discussed. The lock body 26 may include one or more wafer receiving slots 148 formed in the bore 113 and dimensioned to receive at least a portion of the wafers 131 extending from the tool operated cylinder 125. It is understood that when the tool operated cylinder 125 does not have the appropriate tool, for example a key, inserted into the tool operated cylinder 125 the wafers 131 are positioned to extend from the tool operated cylinder 125 and into the one or more wafer receiving slots 148 positioned adjacent to the tool operated cylinder 125. Since the one or more wafer receiving slots 148 do not extend completely around the circumference of the bore 113, when at least one of the wafers 131 is positioned so that at least part of the wafer 131 is within at least one of the wafer receiving slots 148 the tool operated cylinder 125 is prohibited from rotating about its longitudinal axis, and as a result the cam 127 cannot rotate in order to align the off-centered hole 145 with the short leg shackle hole 112. The lock body 26 may also include a circumferential lip 149 extending around the inside of the bore 113.

Figure 15:
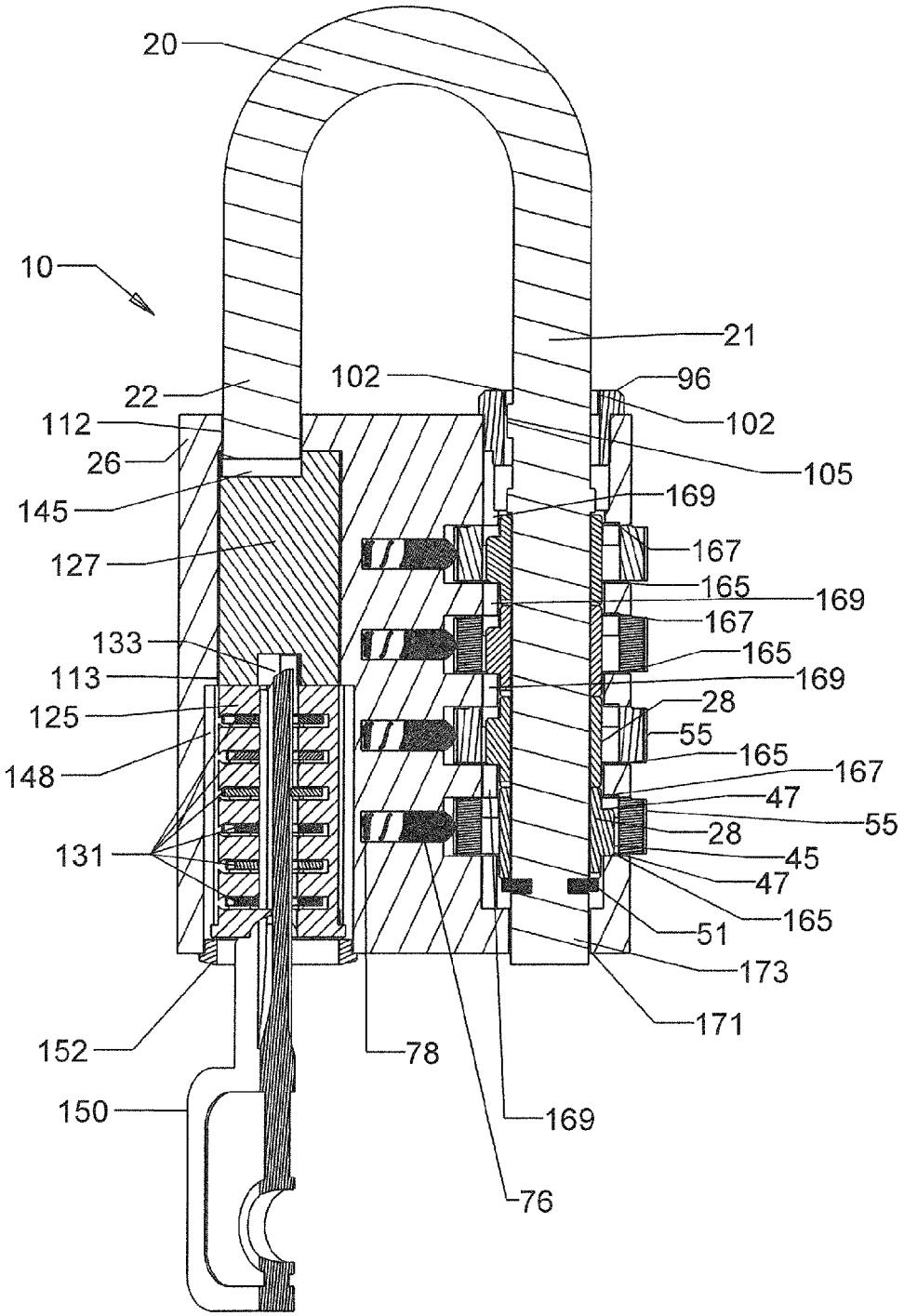
FIG. 15 is a cross-sectional view of the lock body with the shackle in the closed configuration illustrating a key inserted into the secondary locking mechanism of the padlock.
Figure 16:
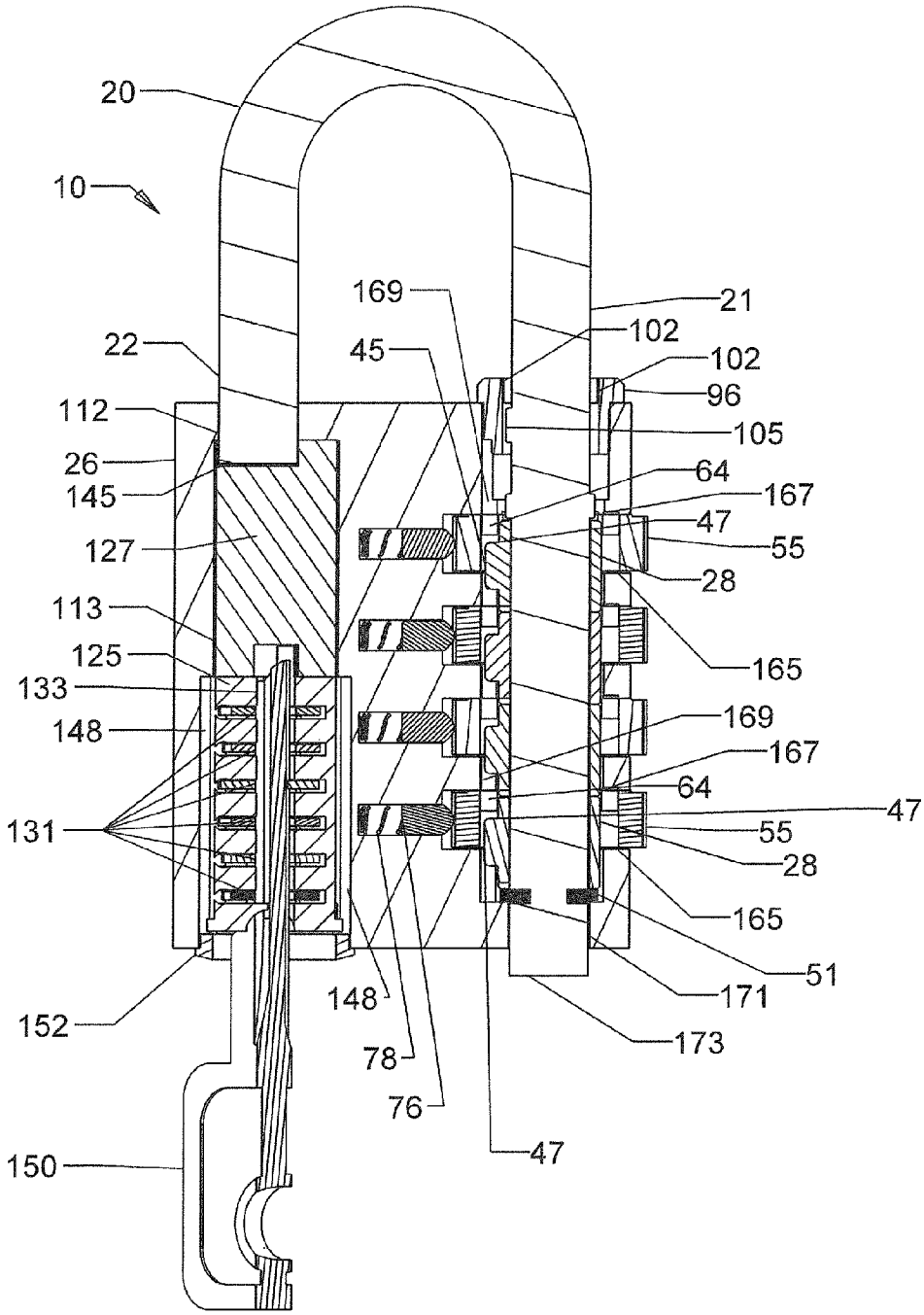
FIG. 16 is a cross-sectional view of the padlock according to the present invention in a combination resetting configuration.

Referring now to FIGS. 15 and 16, when the appropriate tool 150, for example a key, is inserted into the tool channel 133 of the tool operated cylinder 125 the wafers 131 are positioned so that the wafers 131 no longer extend into the wafer receiving slots 148 of the bore 113, and as a result the tool operated cylinder 125 may be rotated in order to cause rotation of the cam 127 and alignment of the off-centered hole 145 with the short leg 22 of the shackle 20. As will be discussed further below, this alignment of the off-centered hole 145 with the shackle permits the shackle 20 to be urged in a direction towards the lock body 26.

Figure 9A:
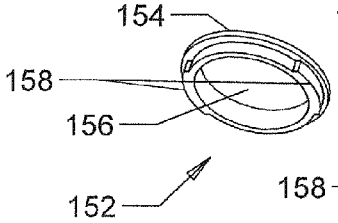
FIGS. 9A-9B are a series of perspective views showing the bottom seal cap of the padlock with the secondary locking mechanism of the present invention.
Figure 9B:
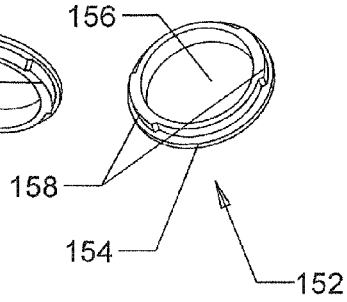

Referring now to FIGS. 1, 9A and 9B, the padlock 10 may also include a bottom seal cap 152 inserted at an end of the bore 113 that may be configured to secure the tool operated cylinder 125 and the cam 127 into the bore 113 in order to eliminate and/or reduce the likelihood of tampering of the padlock 10. The bottom seal cap 152 includes a circular ring 154 having an opening 156 formed therein, and at least one protrusion 158 extending there from. The at least one protrusion 158 may be configured so as to securely fit into the wafer receiving slots 148, in order to provide the bottom seal cap 152 with an extensive grip which makes it more difficult for an intruder to twist the bottom seal cap 152 and damage or open the padlock 10. The bottom seal cap 152 may be press-fit into the bore 113 or may be secured by other means such as an adhesive or other bonding technique.

Figure 4A:
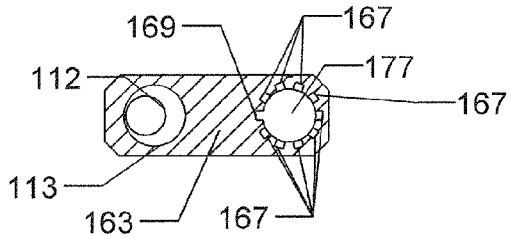
FIG. 4A is a cross-sectional view of the lock body, taken along line 4A-4A of FIG. 3.

Referring now to FIGS. 1-3, 4A, 4B and 5, the exemplary lock body 26 that may be used with the exemplary padlock 10 according to the present invention is shown. The lock body 26 includes the plurality of cylindrical slots 88 that are dimensioned to receive the pins 76 and springs 78 that are used to provide an indication regarding rotation of the rotatable dials 55. Each of the cylindrical slots 88 extends into a cut-out portion 161 of the lock body 26. Each cut-out portion 161 is dimensioned to receive a rotatable dial 55 so that the rotatable dial 55 is able to freely rotate about the long leg 21 of the shackle 20 when the long leg 21 is inserted into the shackle long leg bore 177. Each of the cut-out portions 161 includes an upper surface 163 and a lower surface 165. Each upper surface 163 as shown in FIG. 4A, for example, includes a plurality of faulty-notch zones 167 formed in the upper surface 163. Preferably, each upper surface 163 may include nine faulty-notch zones 167, but it is understood that the present invention is not limited to any particular number of faulty-notch zones 167. The plurality of faulty-notch zones 167 are positioned on the upper surface 163 so that if an unauthorized third-party, e.g. an intruder or thief, attempts to determine the combination for opening the padlock 10 by pulling the shackle 20 in a direction away from the top of the lock body 26 the tip 47 of the extended fin 45 of the clutch 28 may enter one of the faulty-notch zones 167 so that a faulty clicking sound and/or feel is noticed by the unauthorized third-party. The faulty-notches side 167 can inhibit the unauthorized third-party from picking the padlock 10 by using the sound of "clicking" or feeling for the correct notches for opening/unlocking the padlock 10. This increases the difficulty of picking the padlock 10 by determining the combination for opening the combination locking mechanism of the padlock 10, because it becomes more difficult to feel the tip 47 of the extended fin 45 enter into the correct area in the lock body 26 for opening the padlock 10 through use of the combination.

The upper surface 163 and the lower surface 165 are connected by an opening notch 169 that is dimensioned so as to allow the extended fin 45 of the clutch 28 to pass through when the extended fin 45 is aligned with the opening notch 169. In this manner, when all of the extended fins 45 of the clutches 28 are aligned with the opening notches 169 formed in the lock body 26, for example when the correct combination has been set on the padlock 10, the shackle 20 may be moved in a direction away from the lock body 26 in order to permit opening and/or unlocking of the padlock 10, this configuration is shown for example in FIG. 12.

Referring again to FIGS. 1-3, 4A, 4B and 5, it can be seen that the lower surface 165 does not include any faulty-notch zones, however it is understood that the cam 127 is configured to prevent the short leg 22 of the shackle 20 from being pushed towards the lock body 26. As such, it is understood that an unauthorized third-party cannot urge the shackle 20 towards the lock body 26 in order to attempt to determine the combination for the padlock 10 without first using the correct tool, e.g. key 150, to cause alignment of the off-centered hole 145 with the short-leg shackle hole 112. The lock body 26 may also include a bottom hole 171 at an end of the shackle long leg bore 177 that is dimensioned so that a long-leg end 173 of the long leg 21 of the shackle 21 may pass through and/or be rotated within the bottom hole 171. The lock body 26 may also include one or more notches 175 at the other end of the shackle long leg bore 177 that are configured to receive the extended protrusions 101 of the top cap seal 96 in order to prohibit an unauthorized third-party from twisting the top cap seal 96 from the lock body 26 and tampering with the padlock 10 in an unauthorized and/or destructive manner.

Figure 11:
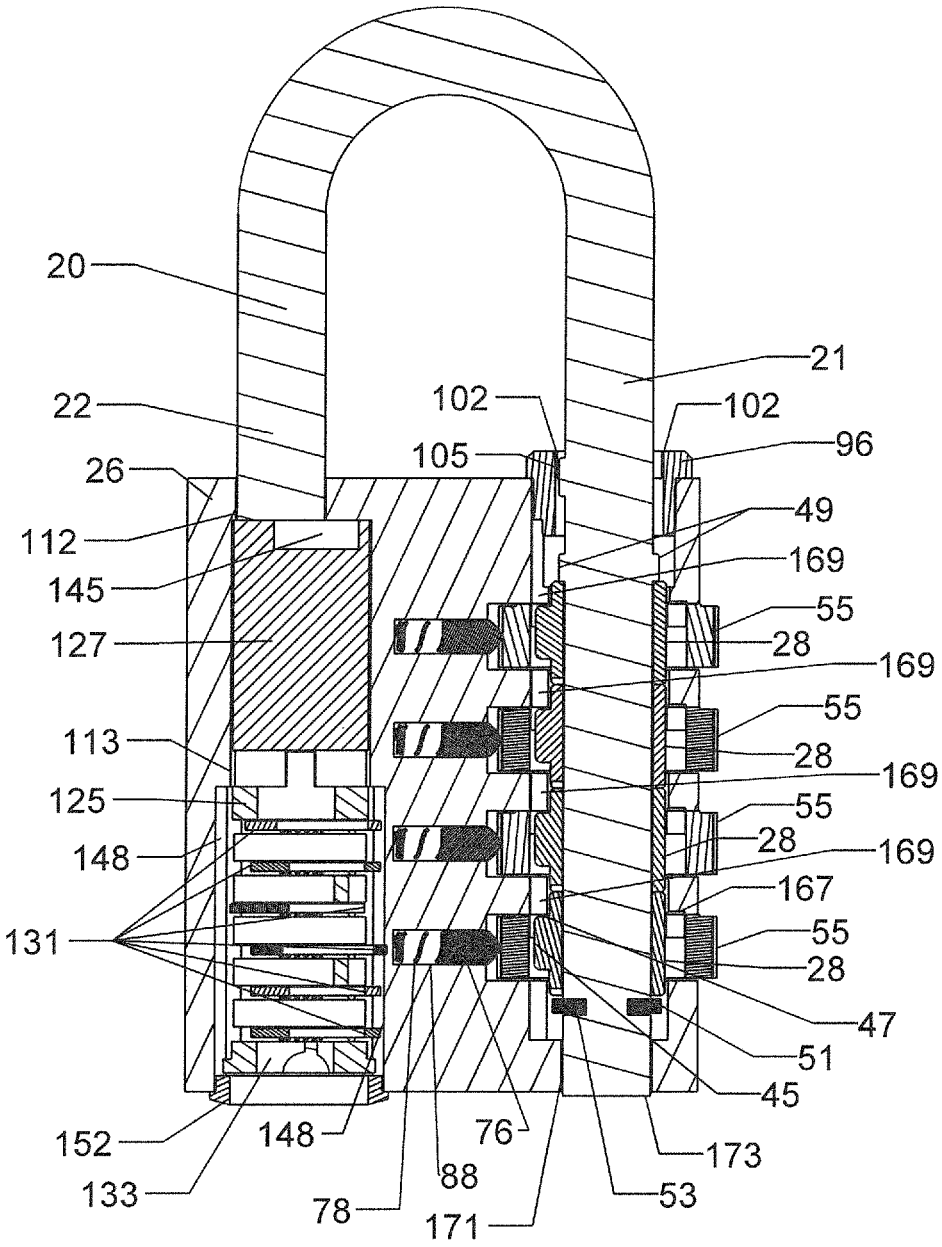
FIG. 11 is a cross-sectional view of an exemplary padlock of the present invention showing the internal components of the padlock in the opened or unlocked state, in which the shackle is ready to be pulled out of the short leg shackle hole of the lock body.

Operation and use of the combination locking mechanism to open/unlock and lock the padlock 10 will now be discussed with reference to FIGS. 1, 11 and 12. FIG. 1 provides an exemplary of the locked mode of the padlock 10 in which the short leg 22 of the shackle 20 is positioned in the short-leg shackle hole 112 of the lock body 26. In the locked mode of the combination locking mechanism of the padlock 10, one or more of the dials 55 are not set to the correct indicia 68 so that the correct combination for the combination locking mechanism is not set. When one or more of the dials 55 are not set to the correct indicia 68 for the combination, the extended fin 45 of each the clutch 28 associated with each incorrectly set dial is not aligned with the opening-notch 169 of the lock body 26. As a result, the upper surface 163 blocks movement of each of the extended fins 45 so that shackle 20 cannot move in a longitudinal direction away from the lock body 26, and the padlock 10 remains in the locked configuration. This configuration is shown for example in FIG. 1, in which the lower most rotatable dial 55 has not been set to the correct indicia 68, and as a result the extended fin 45 of the clutch 28 associated with that rotatable dial 55 is not positioned in alignment with the opening-notch 169 of the lock body 26.

Figure 12:
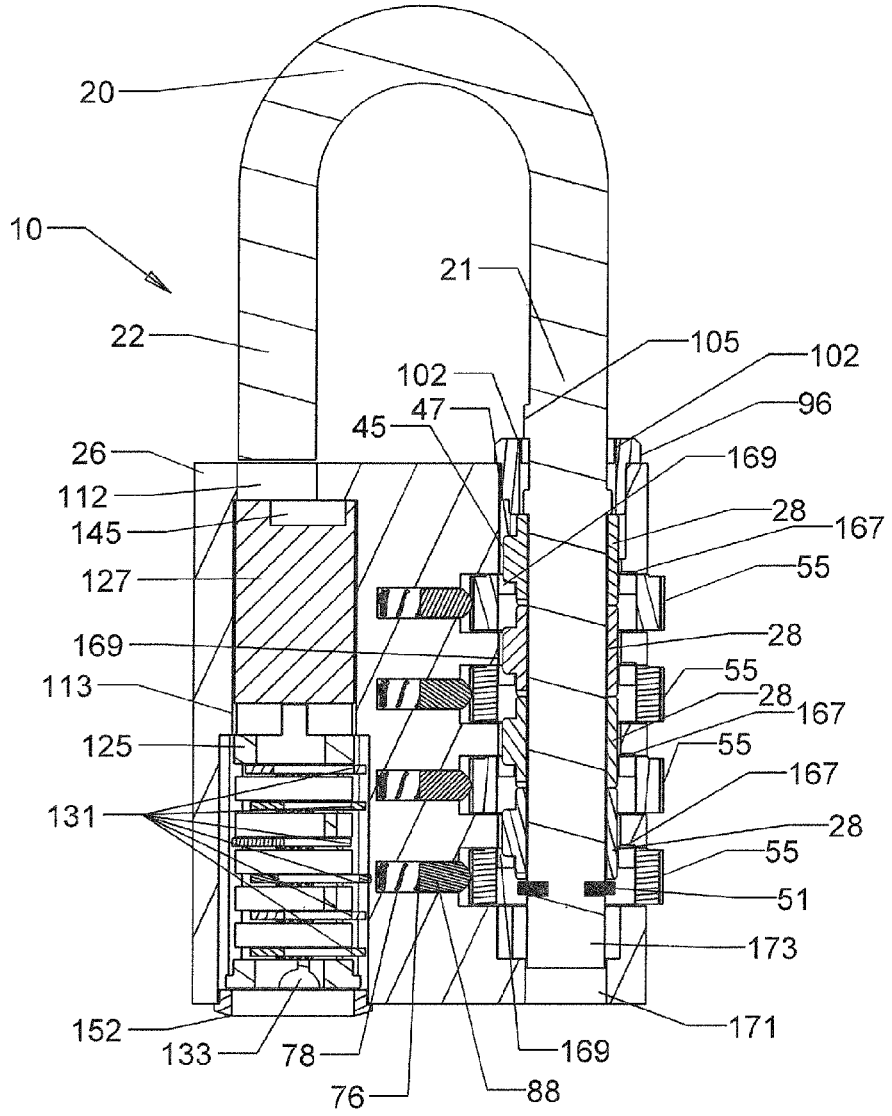
FIG. 12 is a cross-sectional view of an exemplary padlock of the present invention showing the internal components of the padlock in the opened or unlocked state, in which the shackle is pulled out of the short leg shackle hole of the lock body.

In order to place the padlock 10 into the opened/unlocked configuration, as shown for example in FIG. 12, all of the dials 55 must be set so that the correct indicia 68 are displayed so that the correct combination is set on the combination locking mechanism. As shown in FIG. 11, when the correct combination is set all of the extended fins 45 of the clutches 28 are aligned with the opening-notches 169 of the lock body 26. This aligned configuration permits the shackle 20 to be moved in a direction away from the lock body 26 since the extended fins 45 may pass through the opening-notches 169 of the lock body 26. As shown for example in FIG. 12, when the shackle 20 is moved in a direction along the longitudinal axis of the long leg 21 of the shackle 20 away from the lock body 26 the short leg 22 of the shackle 20 may be removed from the short-leg shackle hole 112 of the lock body 26. The shackle 20 is then able to rotate about the long leg 21 of the shackle 20. It is understood that the clutches 28 are dimensioned so that they do not pass through the top cap seal 96, and thereby permitting the long leg 21 of the shackle 20 to be retained within the lock body 26. In the opened/unlocked configuration of the padlock 10, since the shackle 20 is free to rotate the shackle 20 may be placed around an object or objects (not shown) that are desired to be secured by the padlock 10. In order to close/lock the padlock 10, the short leg 22 of the shackle 20 is re-aligned with the short-leg shackle hole 112, and the shackle 20 is moved in a direction towards the lock body 26 so that the short leg 22 is re-inserted into the short-leg shackle hole 112. Furthermore, by moving the shackle 20 back towards the lock body 26, the extended fins 45 of the clutches 28 are now positioned below the upper surfaces 163 of the cut-out portions 161 of the lock body 26. In this orientation, one or more of the rotatable dials 55 may be rotated so that the correct indicia 68 for the correct combination is no longer selected, and the extended fin or fins 45 associated with the one or more rotatable dial 55 will no longer be aligned with the corresponding opening notch or notches 169. The padlock 10 will now be in the closed/locked configuration since it will not be possible to move the shackle 20 in a direction away from the lock body 26 without first reorienting the rotatable dials 55 to select the correct combination for the combination locking mechanism.

Figure 14:
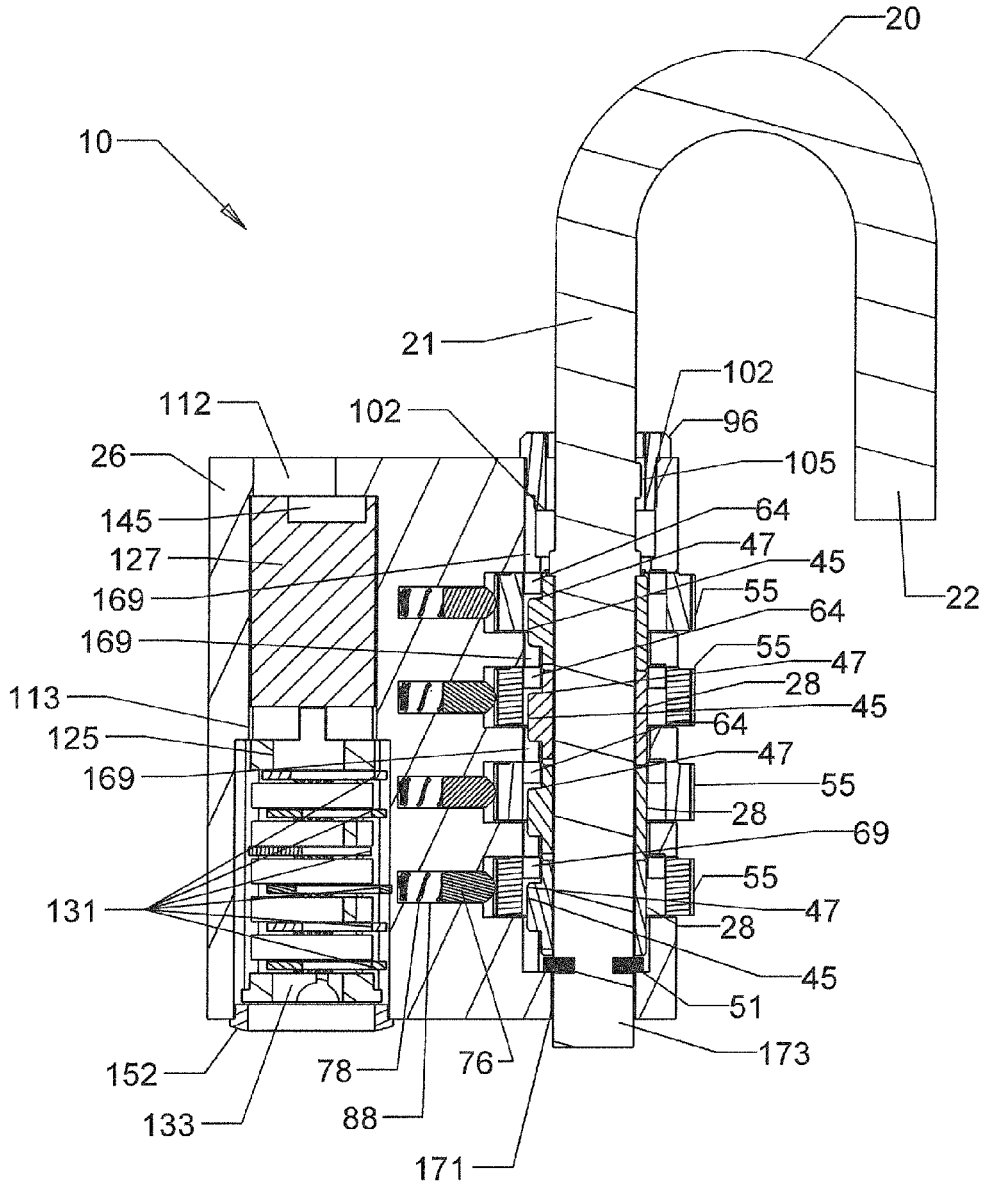
FIG. 14 is a cross-sectional view of the lock body showing the shackle in an open or unlocked configuration.

Referring now to FIGS. 1 and 14, the manner in which the combination for the combination locking mechanism can be reset and/or reconfigured will now be discussed. As discussed above, when the padlock 10 is in the opened/unlocked configuration the shackle 20 may be rotated about the long leg 21 so that the short leg 22 of the shackle 20 may be spaced away from the lock body 26, as shown for example in FIG. 14. In an exemplary embodiment, when the shackle 20 is rotated approximately 180 degrees from the closed/locked position, the protrusion 105 may be inserted into the notch 102 in the top cap seal 96 that is approximately 180 degrees from the notch 102 that the protrusion 105 may be removed from when the shackle 20 is moved away from the lock body 26 after the correct combination has been set on the combination locking mechanism. It is understood that the notches 102 on the top cap seal 96 are positioned so that the shackle 20 may be aligned in the appropriate positions for closing/locking and/or resetting or reconfiguring the combination of the padlock 10. It is understood that at least one notch 102 should be positioned within the top cap seal 96 so that the shackle 20 may be moved away from the lock body 26, and another notch 102 should be positioned so that the shackle 20 can be oriented in a position that allows for resetting and/or reconfiguration of the correct combination for the combination locking mechanism as discussed further below. It is further understood that the other notch 102 in the top cap seal 96 should be positioned so as to allow the shackle 20 to be moved in a direction towards the lock body 26 without the lock body 26 interfering with the short leg 22 of the shackle 20.

As shown in FIG. 14, when the shackle 20 is rotated the required amount in order to insert the protrusion 105 into one of the notches 102 on the top cap seal 96, the shackle 20 may be moved in a direction towards the lock body 26. This movement allows the long-leg end 173 of the long leg 21 to be pushed out of the bottom hole 171 of the lock body 26. The long-leg-end 173 of the shackle 20 is then exposed out of the lock body 26, which can be used as an indication to the user that the padlock 10 is in a reset combination mode for resetting the combination of the combination locking mechanism. When the shackle 20 is pushed towards the lock body 26, each extended fin 45 of each of the clutches 28 move into the corresponding opening notches 169 and the tips 47 of each of the extended fins 45 of the clutches 28 disengages with the teeth 64 of the corresponding rotatable dial 55. In this position, the user can set their new combination, e.g. code, for the combination locking mechanism by turning the rotatable dials 55 to new desired indicia 68. It is understood, that since the extended fins 45 have been disengaged from the teeth 64 of the dials 55, the dials 55 are free to rotate without causing rotation of the clutches 28. After setting the new combination, the user can move the shackle 20 in a direction away from the lock body 26 and each of the extended fins 45 of the clutches 28 will reengage with the teeth 64 of the corresponding rotatable dials 55. As the user pulls the shackle 20, the long-leg-end 173 of the shackle 20 will be pulled back to the lock body 26. As a result of these movements, the combination locking mechanism has a new combination for opening/unlocking the padlock 10. It is understood that the combination may be either reset, i.e. setting all of the rotatable dials 55 so that the combination is 0-0-0-0, or other appropriately reset combination, or reconfigured to a new combination. It is further understood, that 0-0-0-0 may itself be a new combination for the combination locking mechanism.

Figure 17:
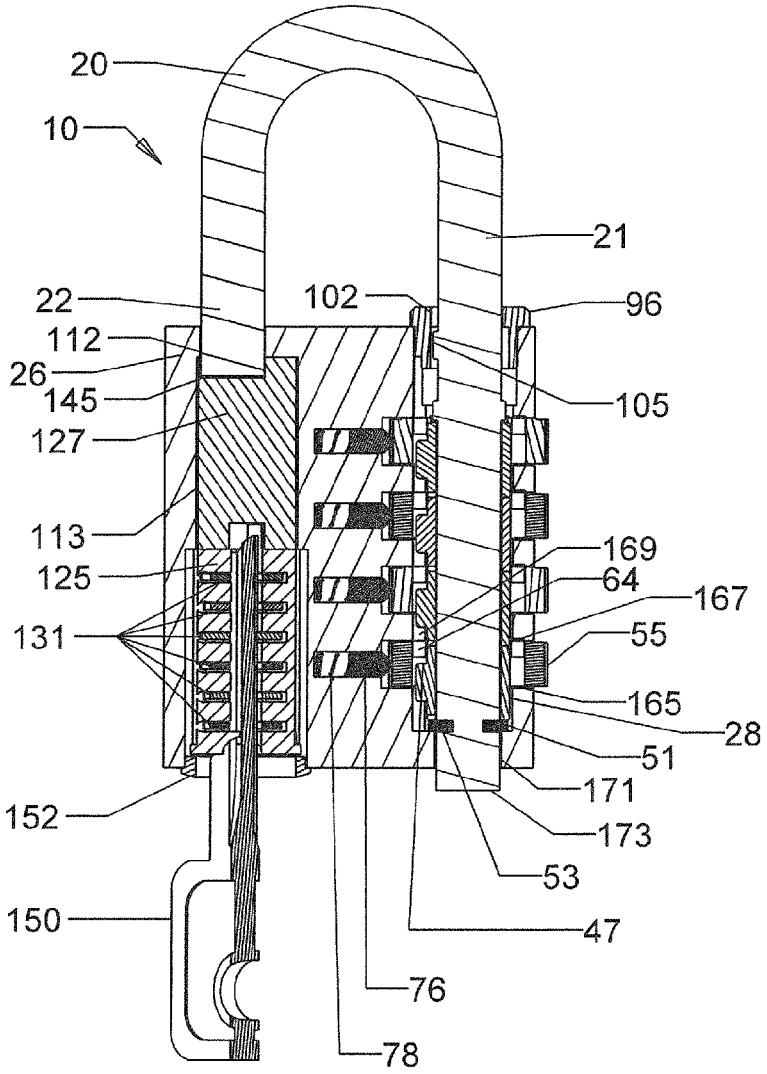
FIG. 17 is a cross-sectional view of the padlock according to the present invention in a combination resetting configuration.
Figure 18A:
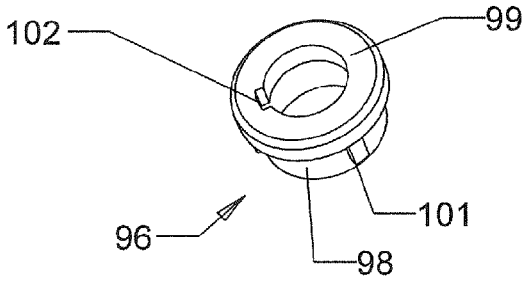
FIGS. 18A-18B are a series of perspective views of the second embodiment of the top cap seal illustrating the cap has only one notch.
Figure 18B:
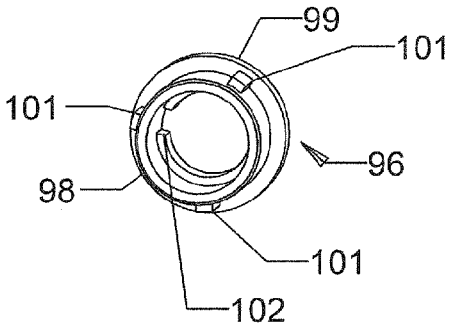

Referring now to FIGS. 17, 18A and 18B, another exemplary embodiment of the padlock 10 that does not include an option for resetting and/or reconfiguring the combination of the combination locking mechanism will be discussed. As shown in FIGS. 18A and 18B, the padlock 10 may include a top cap seal 96 that includes only one notch 102. As with previous exemplary embodiments, this notch 102 permits the protrusion 105 on the long leg 21 of the shackle 20 to be moved past the top cap seal 96 when the shackle 20 is moved in a direction away from the lock body 26. The notch 102 also assists in placing the shackle 20 in proper alignment for movement of the shackle 20 back towards the lock body 26 in order to place the padlock 10 in the closed/locked configuration. However, it is understood that since this exemplary embodiment of the top cap seal 96 includes only a single notch 102, it is not possible to reset and/or reconfigure the combination for the combination locking mechanism after the padlock 10 has been opened/unlocked through use of the combination locking mechanism, because the protrusion 105 only permits the shackle 20 to be reinserted into the lock body 26 in the orientation for closing/locking the padlock 10. As a result, in this exemplary embodiment of the padlock 10 it is not possible to turn the shackle 20 and then reinsert the shackle 20 into the lock body 26 in order to disengage the clutches 28 from the rotatable dials 55 thereby permitting rotation of the rotatable dials 55 without causing rotation of the clutches 28. Accordingly, it is not possible to disengage the clutches 28 from the rotatable dials 55 without use of the tool operated cylinder 125 and the cam 127, as discussed further below. The reason for this exemplary embodiment is that in some countries, such as Japan, the homeowner may like to have more than one agent to sell the house. However, some agents may set a combination code such that another agent cannot have access to the house. By providing this single notch 102 in top cap seal 96, the combination users (agents) cannot reset the padlock 10; the only person who can reset the padlock 10 is the homeowner. The homeowner can tell the combination to the agents; yet, the agents cannot reset the combination. This embodiment of the invention acts like a fixed combination padlock 10 for the (Combination User) agents, and yet it is also a full function combination padlock 10 with reset code functionality for the homeowner (key-user). This reduces issues associated with multiple agents selling a house.

Referring now to FIGS. 15-17, the operation and use of the tool operated cylinder 125 and cam 127 in determining the combination of the combination locking mechanism, opening/unlocking the padlock and/or resetting and/or reconfiguring the combination of the combination locking mechanism will now be discussed. When a correct tool, for example a correct cut key 150, is inserted into the tool channel 133 of the tool operated cylinder 125 the wafers 131 are actuated by the correct cut key 150 so that they no longer extend into the wafer receiving slot 148, as shown for example in FIG. 15. As a result, rotational movement applied to the correct cut key 150 causes rotation of the tool operated cylinder 125. This rotation of the tool operated cylinder 125 is transferred to the cam 127 by interaction of the fork 137 on the tool operated cylinder 125 and the legs 143 on the cam 127. As the cam 127 rotates, the off-centered hole 145 of the cam 127 aligns with the short-leg shackle hole 112 of the lock body 26. When the off-centered hole 145 and the short-leg shackle hole 112 are aligned, the short-leg 22 of the shackle 20 is no longer blocked by the surface 141 of the cam 127. As a result, the user of the padlock 10 is then able to push the shackle 20 towards the lock body 26 and in the direction of the off-centered hole 145 of the cam 127.

As the shackle 20 is being pushed towards the lock body 26, the extended fins 45 of each of the clutches 28 contact the lower surface 165 of each of the cutout portions 161 of the lock body 26 for each rotatable dial 55 that has not been set to the correct indicia 68 for the correct combination of the combination locking mechanism. For example, the lowermost rotatable dial 55 in FIG. 15 shows that the extended fin 45 of the clutch 28 associated with that rotatable dial 55 has not been aligned with the opening notch 169 formed in that cutout portion 161. It is understood that as the shackle 20 is urged in the direction of the lock body 26, any clutch 28 associated with a rotatable dial 55 that is not set to the correct indicia 68 for the combination, will have the extended fin 45 for that clutch 28 come into contact with the lower surface 165 of the cutout portion 161. It is further understood that the correct indicia 68 for each rotatable dial 55 can be determined by turning each rotatable dial 55 until the extended fin 45 for the clutch 28 associated with each rotatable dial 55 comes into contact with the opening notch 169 in the cutout portion 161 for the rotatable dial 55. When the extended fin 45 contacts the opening notch 169 enough resistance should be put on the rotatable dial 55 so that the dial's 55 rotation is stopped and/or interrupted in order to indicate that the indicia 68 currently displayed on the rotatable dial 55 is the correct indicia 68 for the combination for the combination locking mechanism. It is understood that when the rotatable dial 55 stops rotating the extended fin 45 is aligned with the corresponding opening notch 169. The remaining rotatable dials 55 are rotated in the same manner until the correct indicia 68 is displayed for each rotatable dial 55, and as a result the correct combination for the combination locking mechanism can be determined.

It may also be possible to rotate all of the rotatable dials 55 of the padlock 10 at the same time while continuing to urge the shackle 20 towards the lock body 26 in order to achieve the same result. By turning all of the rotatable dials 55, the extended fins 45 of the clutches 28 will automatically fall into the opening notches 169 of the lock body 26. As the shackle 20 is pushed in a direction towards the lock body 26, the extended fin 45 of the clutch 28 will now be in contact with the lower surface 165 of the lock body 26. Since the clutch 28 has only one extended fin 45, this will help the user to pick the combination by turning the rotatable dials 55 with a full cycle to make sure that the extended fin 45 will fall into the opening-notch 169 of the lock body 26. For example, the user can turn all of the rotatable dials 55 at 0-0-0-0 then turn the bottom rotatable dial 55 from 0-0-0-1, 0-0-0-2, . . . 0-0-0-9, and back to 0-0-0-0 for reset the bottom rotatable dial 55. Then turn the next rotatable dial 55 from 0-0-0-0, 0-0-1-0, 0-0-2-0, . . . 0-0-9-0, and back to 0-0-0-0. By turning the rotatable dials 55 from bottom to the top, then all of the extended fins 45 of the clutches 28 will automatically fall into the opening notches 169 of the lock body 26.

In addition, if the shackle 20 is continued to be urged towards the lock body 26, the extended fins 45 of the clutches 28 fully disengages with the teeth 64 of the rotatable dials 55, thereby placing the padlock 10 in the combination reset mode, as discussed above. In the combination reset mode, the long-leg end 173 of the shackle 20 passes through the hole 171 of the lock body 26 and the long-leg end 173 is exposed, indicating to the user that the padlock 10 is in reset mode. As shown for example in FIG. 16, while in the combination reset mode all of the extended fins 45 of the clutches 28 will be in the opening-notches 169 of the lock body 26. The user can then turn the rotatable dials 55 to a desired combination or reset the combination for the combination locking mechanism to a default combination, such as 0-0-0-0. The shackle 20 may then be moved in a direction away from the lock body 26 in order to reposition the short leg 22 of the shackle 20 in the short-leg shackle hole 112 in the lock body 26, and the correct cut key 150 may be turned in order to rotate the tool operated cylinder 125 and the cam 127 so that the off-centered hole 145 is not aligned with the short-leg shackle hole 112 of the body 26. The padlock 10 is now ready for the user to handout this padlock 10 to a new user, in order to permit the new user to set his/her own new combination for the combination locking mechanism, if the padlock 10 permits using the combination locking mechanism for resetting/reconfiguring the combination of the combination locking mechanism.

In this mode of operation, the user (manager) can change the padlock 10 from a locked mode (where the combination for the combination locking mechanism is unknown to the manager) into the reset mode. While in the reset mode, the user can reset the padlock 10 to any code, e.g., 0-0-0-0. After setting the combination, the user can pull the shackle 20 of the padlock 10 away from the lock body 26 and remove the correct cut key 150, and the padlock 10 is ready to be used by a new user to set his/her own code.

It is understood that the padlock 10, and its components including by not limited to the shackle 20 and lock body 26 may be made from any suitable materials. For example, the padlock 10 and its components may be made from any suitable metal, such as steel, aluminum, stainless steel, and/or any suitable plastics. The materials selected for each component of the padlock 10 may be dependent upon the desired durability and/or security of the component, as well as the cost associated with producing such component.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense.

It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A padlock, comprising:

a lock body;

a shackle having a long leg and a short leg, wherein the shackle is movable between a locked configuration in which the short leg is at least partially surrounded by the lock body, and a unlocked configuration in which the short leg is removed from the lock body;

a combination locking mechanism comprising at least one clutch mounted around the long leg of the shackle and configured for rotation about the long leg of the shackle, and at least one rotatable dial operatively engaged with the at least one clutch and configured to impart rotational motion upon the at least one clutch;

a tool operated locking mechanism comprising a cam and a cylinder operatively engaged with the cam, wherein the cam comprises an off-centered hole formed therein, and wherein the tool operated locking mechanism is movable between a blocking configuration in which the off-centered hole is not aligned with the short leg of the shackle and an open configuration in which the off-centered hole is aligned with the short leg of the shackle;

wherein the shackle is further movable to a combination reset configuration at least when the tool operated locking mechanism is in the open configuration, and in the combination reset configuration the at least one rotatable dial is disengaged from the at least one clutch so that the at least one rotatable dial is free to rotate without imparting rotational motion upon the at least one clutch.

2. The padlock according to claim 1, wherein the at least one clutch comprises an extended fin radially extending from an outer surface of the at least one clutch, and wherein the at least one rotatable dial comprises a plurality of teeth configured to engage with the extended fin of the at least one clutch so that rotational motion of the at least one rotatable dial is transferred to the at least one clutch.

3. The padlock according to claim 2, wherein the lock body comprises a first bore dimensioned to receive at least part of the long leg of the shackle and the at least one clutch, and at least one cutout portion positioned substantially perpendicular to the first bore and dimensioned to receive the at least one rotatable dial; and wherein the at least one cutout portion comprises an upper surface and a lower surface, and the upper surface having an upper notch and a plurality of faulty-notch zones, and the lower surface having a lower notch substantially aligned with the upper notch.

4. The padlock according to claim 3, wherein the upper notch and the lower notch are dimensioned so as to allow at least the extended fin of the at least one clutch to pass therethrough when the extended fin is aligned with the upper notch or the lower notch; and wherein the shackle is movable to the unlocked configuration when the extended fin is aligned with the upper notch.

5. The padlock according to claim 4, wherein the at least one rotatable dial comprises a plurality of faces, and each face of the plurality of faces comprises an indicia thereon; and wherein one of the indicia on the plurality of faces provides an indication when the extended fin is aligned with the upper notch.

6. The padlock according to claim 4, further comprising a top cap seal at least partially inserted into an end of the first bore and having a first alignment notch formed therein; wherein the shackle further comprises a protrusion extending from the long leg and configured for alignment with the first alignment notch of the top cap seal when the shackle is movable to the unlocked configuration.

7. The padlock according to claim 6, wherein the shackle is configured for rotation about the long leg when the shackle is in the unlocked configuration; and wherein the top cap seal further comprises a second alignment notch configured for alignment with the protrusion in order to align the shackle into the combination reset configuration and thereby disengaging the at least one clutch from the at least one rotatable dial.

8. The padlock according to claim 7, wherein when the second alignment notch is aligned with the protrusion the shackle is movable in a direction towards the lock body, and such movement is configured to move the extended fin of the at least one clutch into the lower notch and thereby disengage the extended fin from the plurality of teeth of the at least one rotatable dial.

9. The padlock according to claim 3, wherein the cylinder is configured to receive a tool configured to move the tool operated locking mechanism between the blocking configuration and the open configuration; wherein the tool is configured to rotate the cylinder and the cam so that the off-centered hole is aligned with the short leg of the shackle.

10. The padlock according to claim 9, wherein the cylinder comprises a fork configured to contact the cam such that movement of the cylinder is directly transferred to the cam.

11. The padlock according to claim 9, wherein the cylinder and the cam are comprised of a single piece construction.

12. The padlock according to claim 9, wherein the cylinder comprises a lock cylinder, and the tool comprises a correct-cut key configured to operate the lock cylinder.

13. The padlock according to claim 9, wherein when the off-centered hole is aligned with the short leg of the shackle the short leg of the shackle is configured for movement into the off-centered hole and the shackle is configured for movement in a direction towards the lock body.

14. The padlock according to claim 13, wherein when the shackle is moved in the direction towards the lock body the extended fin of the at least one clutch will either contact the lower surface of the cutout portion or engage with the lower notch if a correct indicia for the at least one rotatable dial corresponding to the at least one clutch has been set.

15. The padlock according to claim 14, wherein when the extended fin of the at least one clutch contacts the lower surface of the cutout portion, the rotatable dial may be rotated until the extended fin engages with the lower notch in order to determine the correct indicia for the at least one rotatable dial.

16. The padlock according to claim 14, wherein when the extended fin of the at least one clutch engages with the lower notch the shackle may continue to be moved in the direction towards the lock body and into the combination reset configuration in order to disengaged the extended fin of the at least one clutch from the plurality of teeth of the at least one rotatable dial.

17. The padlock according to claim 9, wherein the lock body further comprises a second bore dimensioned to receive the cam and the cylinder, and a third bore opening into the second bore and dimensioned to receive at least a portion of the short leg of the shackle.

18. The padlock according to claim 17, wherein the off-centered hole of the cam is configured for alignment with the third bore when the tool operated locking mechanism is in the open configuration, and wherein when the tool operated locking mechanism is in the open configuration the short leg of the shackle is positioned so as to enter the third bore and the off-centered hole of the cam.

19. The padlock according to claim 1, further comprising a top cap seal configured to prevent the combination mechanism from being pulled apart from the lock body.

20. The padlock according to claim 1, wherein the combination locking mechanism is configured for entry of a combination configured to permit movement of the shackle into the unlocked configuration.

21. The padlock according to claim 6, wherein the shackle is only movable to the combination reset configuration when the tool operated locking mechanism is in the open configuration.

* * * * *